US010168125B2

(12) United States Patent
Crowe et al.

(10) Patent No.: US 10,168,125 B2
(45) Date of Patent: Jan. 1, 2019

(54) SPRAYABLE COMPOSITION FOR DETERRING INTRUDERS

(71) Applicant: Crotega, LLC, Crystal, MN (US)

(72) Inventors: Jody Allen Crowe, Eagan, MN (US); Oliver D. Nichols, Jordan, MN (US)

(73) Assignee: CROTEGA, LLC, Crystal, MN (US)

( * ) Notice: Subject to any disclaimer, the term of this patent is extended or adjusted under 35 U.S.C. 154(b) by 7 days.

(21) Appl. No.: 15/338,882

(22) Filed: Oct. 31, 2016

(65) Prior Publication Data

US 2017/0045336 A1 Feb. 16, 2017

Related U.S. Application Data

(63) Continuation-in-part of application No. 15/144,195, filed on May 2, 2016, now Pat. No. 9,679,459, which is a continuation-in-part of application No. 14/475,516, filed on Sep. 2, 2014.

(51) Int. Cl.

| | |
|---|---|
| ***F41H 9/00*** | (2006.01) |
| ***G08B 15/02*** | (2006.01) |
| ***C06D 7/00*** | (2006.01) |
| ***G08B 13/16*** | (2006.01) |
| ***F41H 11/00*** | (2006.01) |

(52) U.S. Cl.

CPC ..... *F41H 9/00* (2013.01); *C06D 7/00* (2013.01); *G08B 15/02* (2013.01); *F41H 11/00* (2013.01); *G08B 13/1672* (2013.01)

(58) Field of Classification Search

None

See application file for complete search history.

(56) References Cited

U.S. PATENT DOCUMENTS

| | | | | |
|---|---|---|---|---|
| 5,547,987 | A * | 8/1996 | Bland | A01N 37/02 514/557 |
| 6,183,794 | B1 * | 2/2001 | Kaesler | A01N 37/02 426/335 |
| 6,296,808 | B1 | 10/2001 | Pearman | |
| 6,673,754 | B1 * | 1/2004 | Nabeshima | B24C 11/00 508/136 |
| 8,196,064 | B2 | 6/2012 | Krzyzanowski et al. | |
| 8,303,905 | B2 | 11/2012 | Brents et al. | |

(Continued)

FOREIGN PATENT DOCUMENTS

| | | | | |
|---|---|---|---|---|
| EP | 0241400 | A2 * | 10/1987 | A23B 9/26 |
| EP | 1433149 | A | 6/2004 | |
| FR | 2543796 | A1 | 10/1984 | |

OTHER PUBLICATIONS

Havot (FR 2543796) translation.*

(Continued)

*Primary Examiner* — Aradhana Sasan
*Assistant Examiner* — Quanglong N Truong
(74) *Attorney, Agent, or Firm* — Global IP Counselors, LLP

(57) ABSTRACT

A composition for deterring intruders includes propionic acid, ammonia and water. A content of water in the composition is at least approximately 60% by weight. A system for spraying a composition comprises a nozzle configured to spray the composition in an area inside a building. The composition comprises propionic acid, ammonia and water. A content of water in the composition is at least approximately 60% by weight.

18 Claims, 5 Drawing Sheets

| | 3 : 1 Solution | 1 : 1 Solution |
|---|---|---|
| Time until involuntary eye closure | 20 - 30 seconds | 15 - 25 seconds |
| Mitigation time after flushing with water | 5 - 20 seconds | > 20 seconds and more water needed for mitigation |
| Mitigation of asthma symptoms | Immediately upon introduction of fresh air | Immediately upon introduction of fresh air |
| Removal of odor | Not until washed off | Not until washed off |
| Lingering effects | None | None |

(56) References Cited

U.S. PATENT DOCUMENTS

| | | | | |
|---|---|---|---|---|
| 2008/0111687 | A1 | 5/2008 | Husmann | |
| 2010/0264217 | A1 | 10/2010 | Kumhyr et al. | |
| 2011/0237480 | A1* | 9/2011 | Mizutani ..... | C11D 7/261<br>510/175 |
| 2011/0265880 | A1 | 11/2011 | Kirn | |
| 2012/0092163 | A1 | 4/2012 | Hart | |
| 2012/0296476 | A1 | 11/2012 | Cale et al. | |

OTHER PUBLICATIONS

"Preventing School Shootings, A Summary of a U.S. Secret Service Safe School Initiative Report", NIJ Journal, No. 248, pp. 11-15, 2002.

International Search Report and Written Opinion dated Jun. 16, 2017 in corresponding International Patent Application No. PCT/US2017/024980, filed Mar. 30, 2017.

* cited by examiner

| | 3 : 1 Solution | 1 : 1 Solution |
|---|---|---|
| Time until involuntary eye closure | 20 - 30 seconds | 15 - 25 seconds |
| Mitigation time after flushing with water | 5 - 20 seconds | > 20 seconds and more water needed for mitigation |
| Mitigation of asthma symptoms | Immediately upon introduction of fresh air | Immediately upon introduction of fresh air |
| Removal of odor | Not until washed off | Not until washed off |
| Lingering effects | None | None |

FIG. 5

SPRAYABLE COMPOSITION FOR DETERRING INTRUDERS

CROSS-REFERENCE TO RELATED APPLICATIONS

This application is a continuation-in-part of U.S. patent application Ser. No. 15/144,195, filed on May 2, 2016, which is a continuation-in-part of U.S. patent application Ser. No. 14/475,516, filed on Sep. 2, 2014, the contents of each of which are hereby incorporated herein by reference.

BACKGROUND

Field of the Invention

The present invention generally relates to a sprayable composition for deterring intruders. More specifically, the present invention relates to a sprayable composition that irritates the skin and eyes of a target human subject such as an intruder. The present invention also relates to a system for spraying the sprayable composition inside a building such as a school, workplace, or a home. The sprayable composition beneficially irritates the skin and eyes of a target human subject, such as a home intruder, an active shooter in a public or work place, or a school shooter, for a short time to immobilize the target subject without causing long-term damage to other humans that may inadvertently be sprayed by the composition.

Background Information

Conventional self-defense materials include pepper spray, chemical mace and tear gas. Tear gas is a chemical weapon that causes severe skin, eye and respiratory irritation, as well as vomiting and potential blindness. Tear gas typically contains phenacyl chloride (CN) gas, 2-chlorobenzalmalononitrile (CS) gas, and/or capsicin, the active ingredient in pepper spray. Tear gas is conventionally delivered by being shot from "grenades" which explode to release the compound.

Chemical mace is an irritant and, like tear gas, typically contains CN and/or CS gas. However, unlike tear gas, chemical mace is a sprayable compound in which the CN and/or CS gas is conventionally dissolved in hydrocarbon solvents and delivered via an aerosol spray can. Chemical mace was sometimes found to be ineffective in incapacitating individuals under the influence of drugs or alcohol.

Pepper spray is also conventionally delivered via an aerosol spray can. The active ingredient in pepper spray is not CN or CS gas but rather oleoresin capsicum (OC) gas, which is derived from capsicin. Pepper spray immediately incapacitates an individual by causing inflammation in the skin and eyes, temporary blindness, nausea, pain, difficulty in breathing and an intense burning sensation. The effects of pepper spray last for approximately 20 minutes to an hour, and pepper spray is very difficult to wash off.

Gun violence has become a pervasive problem in the United States. In particular, there have been several recent incidents of active shooters within buildings such as malls or schools. Although many buildings have systems to suppress fires until the fire department arrives, none have a system inside the building to suppress active shooters who breech protected or unprotected entrances or who become active when inside of buildings. The unprotected interior of buildings gives an active shooter or any violent perpetrator unfettered access to victims, creating a veritable "reign of terror" until the perpetrator is confronted by someone who risks their life or by law enforcement, or the perpetrator chooses to desist. The present invention relates to a sprayable material, and a system for using such sprayable material, that can be used to deter, distract, and delay human threats inside of a building, public or private, commercial or home, until law enforcement arrives without causing harm to the victims inside the building or lasting harmful effects to the human threats.

SUMMARY

It has been found that conventional self-defense materials such as pepper spray, chemical mace and tear gas cause significant harm and discomfort that is difficult to mitigate without medical triage to others who come into contact with the materials, such as innocent bystanders or victims who are near the targeted individual. Additionally, conventional self-defense materials such as pepper spray, chemical mace and tear gas impede in-house responders and first responders from accessing the location of the sprayed material for an unacceptable length of time. Therefore, such materials would not be suitable to spray inside a building with an active shooter, such as a mall or a school, because innocent victims who are being targeted by the shooter, in particular children, could also be harmed by the material being sprayed at the intruder.

However, merely spraying water from a building's water supply system on an individual is not enough of a deterrent to incapacitate or temporarily disable intruders such as active shooters while waiting for law enforcement to arrive.

Therefore, there is a need for a sprayable composition that can be used to deter and temporarily incapacitate intruders inside a building without causing significant harm or need of medical triage to others inside the building and to allow for immediate access to the location of the sprayed material. It has been found that a hay treatment product for preventing mold growth on hay may be modified to be suitable for use as such a sprayable composition to deter human threats inside of a building until law enforcement arrives. In particular, the hay treatment product may be diluted with water so that it can be sprayed and used inside a building to spray at intruders to temporarily disable the intruders without causing significant harm to other individuals, such as victims, who are also inside the building, and to allow ingress and egress through the sprayed area.

In view of the state of the known technology, one aspect of the present disclosure is to provide a system for spraying a deterrent composition. The system includes a nozzle configured to spray the deterrent composition in an area inside a building. The deterrent composition comprises propionic acid, citric acid, ethoxylated alcohol, and water, and the content of water in the composition is at least approximately 60% by weight.

Another aspect of the present disclosure is to provide a deterrent composition comprising propionic acid, citric acid, ethoxylated alcohol, and water. The content of water in the deterrent composition is at least approximately 60% by weight.

BRIEF DESCRIPTION OF THE DRAWINGS

Referring now to the attached drawings which form a part of this original disclosure:

FIG. 5 shows the results of an experiment involving two different sprayable compositions for deterring intruders.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
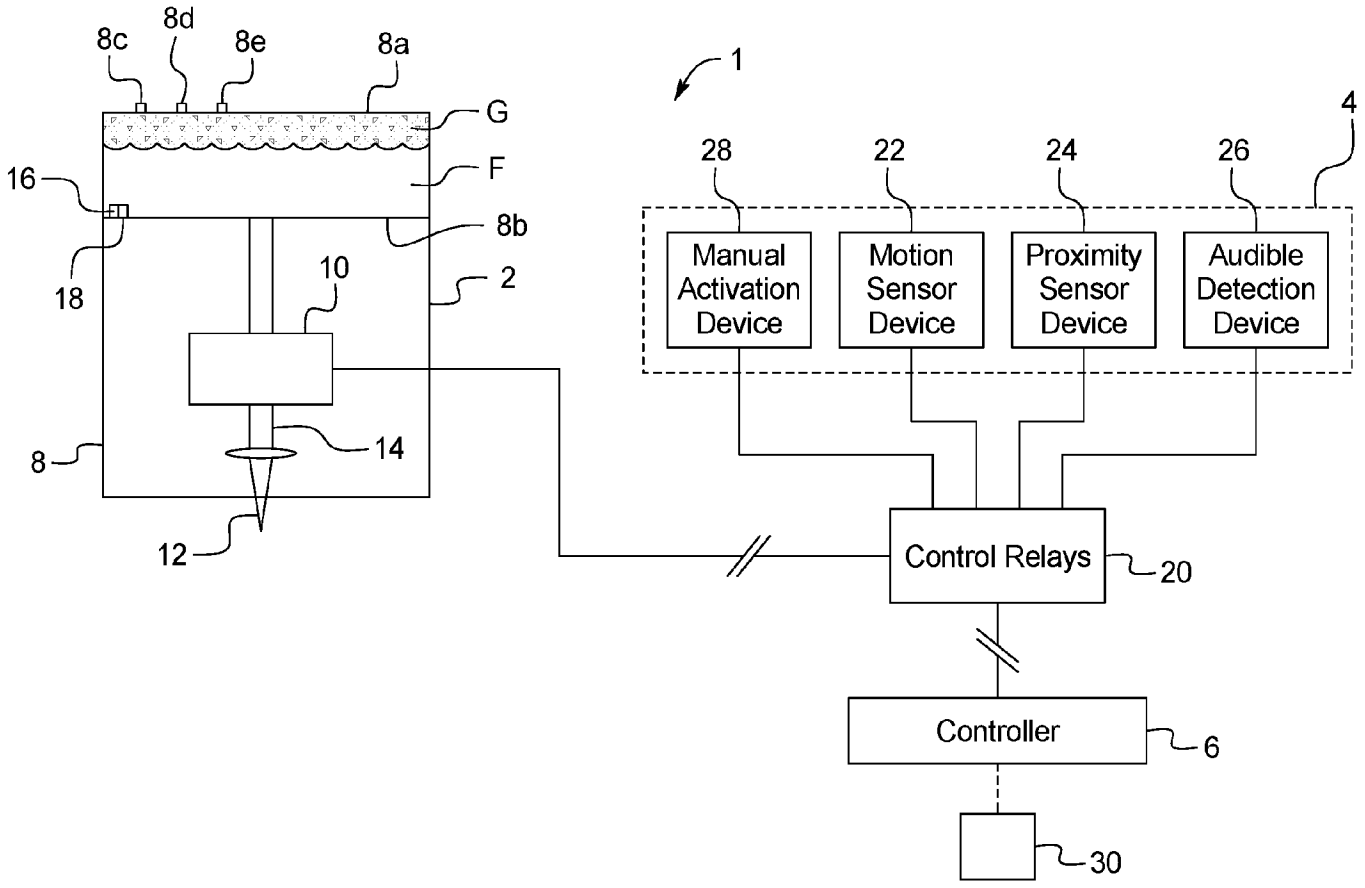
FIG. 1 illustrate a deterrent system for spraying a composition to deter intruders according to an embodiment.
Figure 2:
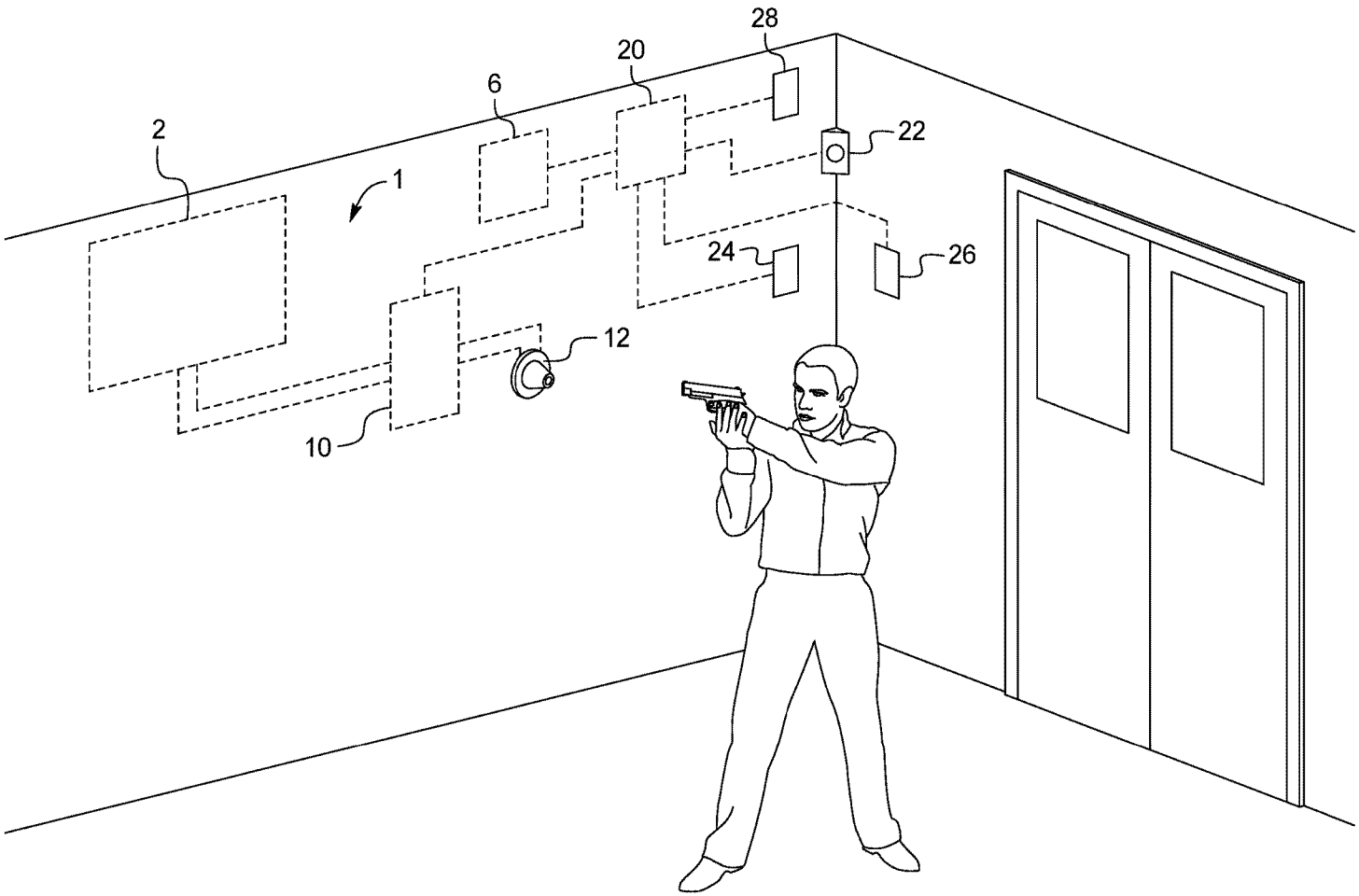
FIG. 2 illustrates an intruder entering an area that is provided with the deterrent system shown in FIG. 1.
Figure 3:
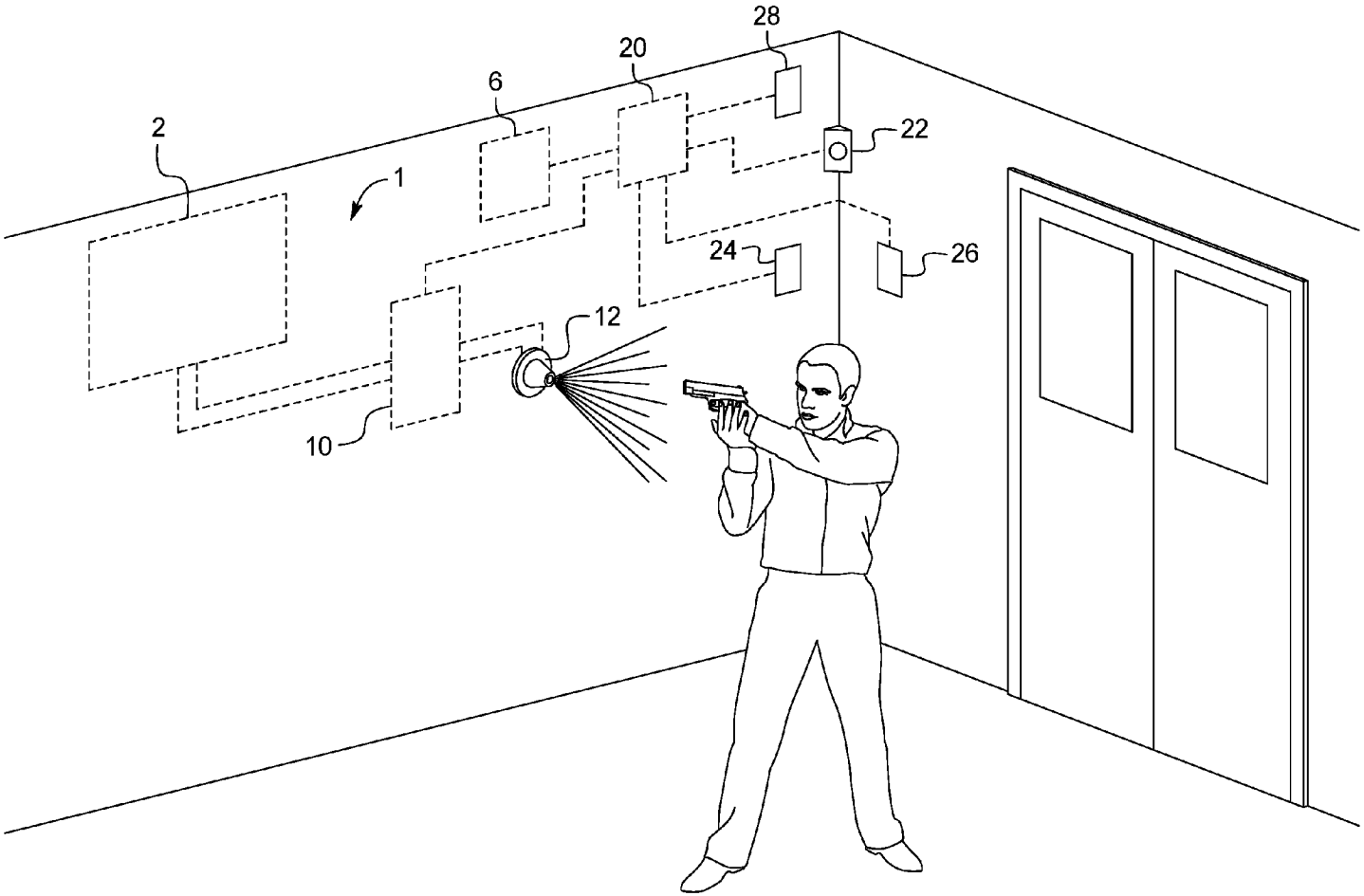
FIG. 3 illustrates the deterrent system shown in FIG. 1 with the sprayable composition being dispensed though a nozzle.

Referring initially to FIGS. 1-3, a deterrent system 1 for spraying a composition to deter intruders is illustrated in accordance with an embodiment. The system 1 includes a module 2 containing the sprayable deterrent composition, a detecting system 4 and a controller 6.

The module 2 containing the sprayable deterrent composition can be self-contained and includes a tank 8, a valve 10 and a nozzle 12. In other words, the deterrent system 1 can be a stand-alone system inside a building, with the module 2 being independent from the water supply system(s) of the building. The module 14 is preferably electrically coupled to the controller 18 and can be controlled thereby, as discussed below.

The tank 8*a* can be a hydro pneumatic solution tank, and includes a top 8*a*, a bottom 8*b*, a fluid valve 8*c* configured to enable fluid F containing the sprayable deterrent composition to be injected into or released from the tank 8, a compressed gas inlet valve 8*d* configured to enable compressed gas G to be injected into the tank 8 so as to form a compressed gas cushion, and a compressed gas relief valve 8*e* configured to enable release of the compressed gas G from the tank 8. As is understood, when compressed gas G is injected into the tank 8, the compressed gas G exerts a pressure on fluid F contained within the tank 8 so that the fluid F containing the sprayable deterrent composition can be sprayed.

The valve 10 can be a controlled area valve, and is in fluid communication with the tank 8. The valve 10 can be any suitable valve that can prohibit the pressurized fluid F from exiting the tank 8 and/or unintentionally passing through the nozzle 12. The valve 10 can be manually or automatically (e.g., via computer controller 6) opened. If desired, the valve 10 can be opened or closed in any suitable manner to prevent over pressurization of the system and tank 8.

The nozzle 12 can be a directional nozzle and can be in fluid communication with the valve 10 through a nozzle outlet 14, which can be disposed proximate to the bottom 8*b* of the tank 8. The nozzle 12 can be any suitable nozzle capable of spraying the fluid F in a predetermined direction and cover a predetermined spray area. In one embodiment, the nozzle direction can be altered or changed to enable the nozzle 12 to be directed to a specific area. The change in nozzle direction can be done manually or controlled by a computer.

In an embodiment, the module 2 for the deterrent system 1 can include a pressure indicator 16 in fluid communication with the tank 8, and a pressure switch 18 in fluid communication with the tank 8.

The controller 6 (central processing computer) can be in electronic communication with the valve 10, the detection system 4, and the pressure switch 18 via a hard wired or a wireless Local Area Network, or any other suitable communication system. The controller 6 preferably includes a microcomputer with a control program that controls the valve as discussed below. The controller 6 can also include other conventional components such as an input interface circuit, an output interface circuit, and storage devices such as a ROM (Read Only Memory) device and a RAM (Random Access Memory) device. The microcomputer of the controller 6 is programmed to control the valve 10, the detection system 4, and the pressure switch 18. The memory circuit stores processing results and control programs such as ones for the valve 10, the detection system 4, and the pressure switch 18 operation that are run by the processor circuit. The controller 6 is operatively coupled to the valve 10, the detection system 4, and the pressure switch 18 in a conventional manner. The internal RAM of the controller 6 stores statuses of operational flags and various control data. The controller 6 is capable of selectively controlling any of the components of the deterrent system 1 in accordance with the control program. It will be apparent to those skilled in the art from this disclosure that the precise structure and algorithms for the controller 6 can be any combination of hardware and software that will carry out the functions of the present invention.

The controller 6 is preferably electrically coupled to a relay board with a control relay 20. The controller 6 can be in electronic communication the relay board via hard a wired or wireless Local Area Network, and the detection system 4 located proximate to the deterrent system 1.

The detecting system 4 can include a motion sensor device 22 and/or a proximity sensor device 24 and/or an audible noise detection device 26 and/or a manual activation device 28. The motion sensor device 22 can be any suitable device that is configured to or capable of sensing motion. For example, the motion sensor device 22 operate using passive infrared (PIR), microwaves, ultrasonic waves and video camera software, or any other suitable technology.

Passive infrared sensors are sensitive to a person's skin temperature through emitted black body radiation at mid-infrared wavelengths, in contrast to background objects at room temperature. No energy is emitted from the sensor, thus the name "passive infrared" (PIR).

Microwave motion detectors detect motion through the principle of Doppler radar, and are similar to a radar speed gun. A continuous wave of microwave radiation is emitted, and phase shifts in the reflected microwaves due to motion of an object toward (or away from) the receiver result in a heterodyne signal at low audio frequencies.

Ultrasonic detectors use an ultrasonic wave (sound at a frequency higher than a human ear can hear) is emitted and reflections from nearby objects are received. Similar to Doppler radar, heterodyne detection of the received field indicates motion. The detected Doppler shift is also at low audio frequencies (for walking speeds) since the ultrasonic wavelength of around a centimeter is similar to the wavelengths used in microwave motion detectors.

Video cameras can be used to detect motion from the output of the camera. This solution is particularly attractive when the intention is to record video triggered by motion detection, as no hardware beyond the camera and computer is required.

Accordingly, when an intruder is moving in an undesired area, the motion sensor device 22 can sense motion and transmit a signal to the controller 6 that undesired movement is occurring in a location.

The proximity sensor device 24 can be any sensor capable of detecting the presence of nearby objects without any physical contact. For example, the proximity sensor device 24 can emit an electromagnetic signal or a beam of electromagnetic radiation (e.g., infrared) into the field and detect a change in the return signal.

The manual activation device 28 can be any manual device in the proximity of the deterrent system 1 or in any other position. For example, the manual activation device 28 can be a button, lever or any other suitable activation device that would enable manual activation of the deterrent system 1. The manual activation device 28 can be located within eyesight of the location of the module 2. The manual activation device 28 can be connected to the controller 6 (central processing computer) via a hardwired or wireless Local Area Network.

The audible noise detection device 26 can be a gunshot detection activation system or any other suitable device for detecting a noise that indicates a threat such as a dangerous intruder is nearby. For example, the audible noise detection device 26 can be configured to determine when a gunshot has occurred and send a signal to the controller 6 indicating that a gunshot has occurred. The audible noise detection device 26 detects the location of gunfire or other weapon fire using acoustic, optical, or other suitable sensors, or a combination of such sensors.

The detecting system 4 can be connected to the control relay 20, which is, in turn, connected to the controller 6. The controller 6, upon receiving a signal from any sensor or device in the detection system 4, using the logic built into the software, sends a signal to the control relay 20, causing the valve 10 or valves 10 in the module 2 to open, which sends the pressurized fluid containing the sprayable deterrent composition through the nozzles 12 in the module 2. The nozzles 12 can have various designs that cause the pressurized fluid to be sprayed in a pattern designed for maximum coverage.

Thus, the controller 6 comprises a sensor recognition and signal activation software application system for receiving and recognizing sensor alerts from the detecting system 4 and for sending activation signals to the valve to regulate and control fluid movement through the valve 10 and to the nozzle 12.

In other words, the deterrent system 1 can be activated by visual observation of an intruder, by an audible noise detection device 26, such as a gunshot detection activation system, or by the presence of an intruder via a proximity sensor device 24 and/or a motion sensor device 22.

Thus, as is understood, the deterrent system 1 can use pressurized fluid F containing the sprayable deterrent composition delivered through a nozzle 12 as a shield to deter, delay, and distract violent perpetrators inside of a building. The deterrent system 1 is preferably a stand-alone deterrent system 1 with a tank 8 having pressurized gas G therein to cause the fluid F to be dispersed through the nozzle 12. However, the deterrent system 1 can utilize the building fire suppression sprinkler water delivery system for water delivery to the tank 8 to be mixed with another fluid to form the sprayable deterrent composition. The fluid F contains the sprayable deterrent composition and becomes a distracting and defensive shield when the system is activated. System activation can occur when a detecting system 16 detects a gunshot or undesired movement or presence of an intruder and/or by manual activation by building occupants upon visual recognition of a threat by the building occupants.

Figure 4:
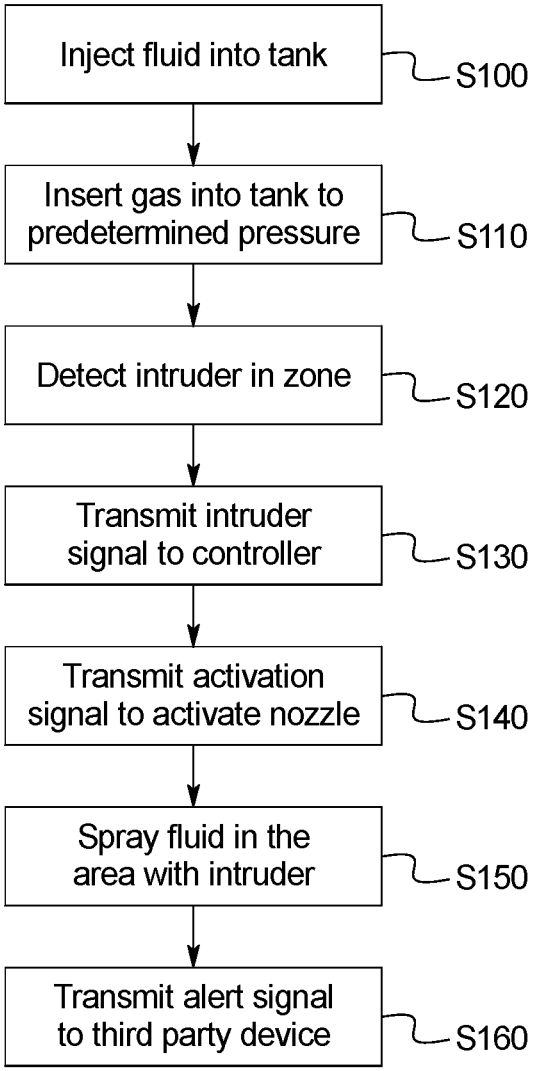
FIG. 4 illustrates a method of operating the deterrent system of FIG. 1.

FIG. 4 is a flow chart illustrating the method of operation of an embodiment of the deterrent system 1. In step S100, a fluid F containing the sprayable deterrent composition is injected into the tank 8 through the fluid valve 8*c*, and in step S110 a gas G is inserted into the tank 8 through gas inlet valve 8*d*. The gas G causes the tank 8 to be under a predetermined pressure that would enable pressure release of the fluid F containing the sprayable deterrent composition. The predetermined pressure can be monitored via the pressure indicator 16. In step S120, the detecting system 4 detects the presence of an intruder in a zone. As described herein, the detection of the intruder can be accomplished by any one of or combination of a motion sensor 22, a proximity sensor 24, an audible sensor 26 or manual activation of the manual activation device 28, or any other suitable device.

In step S130, an intruder signal is transmitted from the detecting system 4 to the controller 6. The controller 6, in step S140, then sends an activation signal to activate the nozzle 12 in the proper zone to spray the intruder with the fluid F disposed in the tank 8, so as to spray fluid F containing the sprayable deterrent composition into the zone with the intruder in step S150. In step S160, the controller 6 transmits an intruder alert signal to an appropriate third party device 30 (preferably simultaneously with the transmission of the activation signal). For example, the controller 6 can send an intruder signal to the local police department, a building security office, a building administration office, a mobile device, or any other desired location or device.

Deterrent Composition

One embodiment uses a deterrent composition to subdue or temporarily incapacitate intruders. In this embodiment, a diluted hay treatment product was found to be a suitable deterrent composition. Hay treatment products are heat preservatives that are used when bailing hay to prevent mold growth on the hay. One example of a suitable hay treatment product is HAY GREEN™. It has been discovered that the hay treatment product irritates the skin and eyes of those who handle the product to treat hay and, thus, could possibly be effective as a deterrent to intruders inside a building, such as an active shooter inside a school or a mall.

However, known hay treatment products contain irritants that are too strong/concentrated to be sprayed on humans, either on human targets or on other individuals such as potential victims. Furthermore, a hay treatment product was tested using a venturi system to inject the hay treatment product with water onto subjects. As the hay treatment product flows through a tapered orifice in the venture system, a rapid change in velocity occurs to create a vacuum that draws air and the hay treatment product into the system so that it can be injected into a pressurized system. However, it was discovered that the hay treatment product cannot be sprayed well under pressure. Therefore, the various combinations of the hay treatment product and water were tested until a suitable composition was obtained that could be sprayed well under pressure through the deterrent system 1. Moreover, various combinations of the hay treatment product and water were tested to determine their suitability for contact with victims. It was discovered that a suitable composition both for spraying under pressure and for contacting victims such as children was achieved when the hay treatment product was mixed with water at a 1:1 weight ratio.

Known hay treatment products contain propionic acid as the active ingredient, along with citric acid, ethoxylated alcohol, aqueous ammonia, a dye and water. Propionic acid is a short-chain fatty acid that has a strong smell and a low pH of about 3. Propionic acid is a well-known preservative that was used in the hay treatment product to prevent mold growth. It has been discovered that propionic acid is a suitable active ingredient in the sprayable deterrent composition because of its low pH and its effectiveness in irritating the eyes and throat of individuals who come into contact with it. Although other short-chain fatty acids may be suitable for use in the sprayable deterrent composition, propionic acid is more stable than other short-chain fatty acids such as acetic acid. Thus, propionic acid is a desirable active ingredient in the sprayable deterrent composition.

Ammonia is used in both known hay treatment products and the sprayable deterrent composition to increase the pH of the composition to a suitable level for coming into contact with individuals. For example, since the pH of propionic acid is only about 3, if pure propionic acid were sprayed on individuals, it could cause chemical burns and long-term adverse health effects. Therefore, a suitable amount of ammonia is added to the sprayable deterrent composition to raise the pH to a level of 5.0 to 6.0 or another level that is safe to be sprayed on individuals such as children or other victims of an intruder without causing significant harm or long-term adverse health effects.

Water is used in both known hay treatment products and the sprayable deterrent composition as a carrier for the other ingredients. For example, a mixture of just propionic acid and ammonia would result in a solid powder. As such, water is needed to be able to spray the mixture of propionic acid and ammonia in the sprayable deterrent composition. Water also serves as a diluent in the sprayable deterrent composition so that the composition can be sprayed well under pressure and the concentration of the solution can be reduced to a level that is suitable for spraying on individuals such as intruders, children or other victims of intruders without long-term adverse health effects or significant harm.

Ethoxylated alcohol is used in known hay treatment products as a wetting agent to avoid the water repellency of plants. In particular, ethoxylated alcohol is used to allow the hay treatment products to be effectively applied onto hay so that the propionic acid in the products can come into contact with the hay. It should therefore be understood that a sprayable deterrent composition in accordance with this embodiment may optionally include ethoxylated alcohol.

Citric acid is used in known hay treatment products to make the hay more palatable to animals that may consume the hay. Therefore, it should be understood that a sprayable deterrent composition in accordance with this embodiment may optionally include citric acid.

The dye in known hay treatment products is used merely for aesthetic purposes. As such, it should be understood that a sprayable deterrent composition in accordance with this embodiment may optionally include a dye.

A product having the same amount of propionic acid, citric acid, ethoxylated alcohol, aqueous ammonia and water as the hay treatment product was further mixed with water at a 1:1 weight ratio of product to water, and soracid red dye was added in place of the green dye used in the hay treatment product. The resulting sprayable deterrent composition is shown below in Table 1.

TABLE 1

| | HAY TREATMENT PRODUCT (WT %) | SPRAYABLE DETERRENT COMPOSITION (WT %) |
|---|---|---|
| Propionic acid | 70.00 | 35.00 |
| Citric acid | 2.56 | 1.28 |
| Ethoxylated alcohol | 0.49 | 0.245 |
| Aqueous ammonia | 19.60 | 9.80 |
| Green dye | 0.002 | 0 |

TABLE 1-continued

| | HAY TREATMENT PRODUCT (WT %) | SPRAYABLE DETERRENT COMPOSITION (WT %) |
|---|---|---|
| Soracid red dye | 0 | 0.001 |
| Water | 7.348 | 53.674 |

The aqueous ammonia shown in Table 1 consists of 29.5% by weight of ammonia and 70.5% by weight of water. As such, when the water content of the aqueous ammonia is added to the remaining water in the compositions above, the total water content in the hay treatment product is 13.838% by weight, and the total water content in the sprayable deterrent composition is 60.583% by weight.

Although Table 1 only shows a 1:1 composition of water and a concentrate having the same composition as the hay treatment product other than red dye being used instead of green dye, it should be understood that any suitable dilution of water may be used as long as the ratio of water to concentrate is at least 1:1 and, thus, the total content of water in the sprayable deterrent composition is at least approximately 60% by weight. For example, a composition having a 3:1 ratio of water to the hay treatment product may be used as described in Example 1 below and shown in FIG. 5. Similarly, a composition having a 1.5:1 ratio of water to HAY GREEN™ may also be suitable. In particular, a higher ratio of water to the hay treatment product relative to the 1:1 mixture may be desirable for use in areas that are occupied by younger children, such as an elementary school, whereas a 1:1 mixture would be suitable for use in a high school.

Furthermore, although Table 1 only shows a 1:1 composition of water and a concentrate having the same composition as the hay treatment product other than red dye being used instead of green dye, it should be understood that any suitable propionic acid-based concentrate may be used, as long as the resulting sprayable deterrent composition has a sufficient amount of propionic acid, ammonia and water to irritate the eyes and throat of individuals sprayed with the composition without causing significant harm or long-term adverse health effects and can be sprayed well under pressure.

For example, any suitable composition containing propionic acid, ammonia and water may be used as a sprayable deterrent composition, as long as the concentration of the propionic acid is at least approximately 35% by weight, the amount of ammonia is such that the pH of the resulting composition is approximately 5.0 to 6.0, preferably about 5.60 to 5.80, and the total content of water is at least approximately 60% by weight.

As shown in Table 1 above, the hay treatment product composition was also modified to change the dye from a green dye to a soracid red dye. However, a skilled artisan would understand that any suitable dye may be used in the sprayable deterrent composition of the present invention. Alternatively, the sprayable deterrent composition may contain no dye and/or be colorless.

Experimental Results

Initial tests were conducted to determine whether the hay treatment product was suitable for use as a deterrent composition without modification. It was determined that the full-strength hay treatment product was too strong of an irritant to be used in a deterrent system that could inadvertently spray potential victims of an intruder, such as children, or could have potential long-term health effects on the intruder or other humans sprayed with the composition.

Furthermore, the full-strength hay treatment product could not be sprayed well in a venturi system under pressure and, thus, was determined not to be suitable for use in a deterring system such as that shown in FIGS. 1-3.

Additional tests using sprayable deterrent compositions were conducted using a close proximity spray directly to the face of thirteen human subjects to determine the effectiveness of the compositions in causing voluntary eye closure, irritation of the nostrils, throat and lungs, stinging on the skin, and reaction to pungent odor. The thirteen test subjects included one 60-year-old male, two male military veterans, six 18-year-old high school students, two high school teachers, and two male 19-year-old subjects. The six 1-year-old high school students included four males and two females, one of the females being asthmatic. The high school teachers were a male and an asthmatic female.

The sprayable deterrent composition was formed by diluting HAY GREEN™ with water to form a first composition having a 3:1 ratio of water to HAY GREEN™, and the strength of the composition was increased (i.e., the ratio of water to HAY GREEN™ was lowered) to form a second sprayable composition having a 1:1 ratio of water to HAY GREEN™. The duration of exposure of subjects to the sprayed compositions before their eyes involuntarily closed was also measured to determine the amount of exposure time needed for effectiveness.

Tests at close proximity were also used to determine the ease of mitigation using water. The research revealed dilution with water is effective in mitigating the effects of the deterrent compositions. The test subjects were exposed to the compositions, and then their faces and eyes were flushed with water to determine how quickly the effects of the composition were mitigated by water. The period of time between the introduction of water and mitigating of the irritation depended on the amount of composition sprayed in the face of the subject. The mitigation time varied from 5 seconds to 60 seconds and could reappear when considering any residual solution in the hair or face that may travel to the eyes after mitigation. The pungent odor remained until the subject took a shower and had all clothes laundered.

The tests were conducted in a research lab that includes four nozzles for spraying the composition in two defined zones. In particular, Zone 1 included a first nozzle in a simulated vestibule and a second nozzle located five feet from the vestibule door on the interior side of a simulated lobby. Zone 2 included a third nozzle centered 10 feet from the second nozzle, and a fourth nozzle centered 10 feet from the third nozzle. The total length of the simulation site in the research lab was 40 feet, and the total width of the simulation site was approximately 10 to 14 feet.

Each nozzle is designed to dispense approximately 4 gallons of the composition. The nozzles dispense roughly 1.5 gallons of the sprayable composition in ten second bursts. Each nozzle can supply up to 3 bursts of the sprayable composition.

The tests were performed with the test subjects wearing full raingear, baseball hats, eye glasses and no other protection. The test subjects were given various tasks to complete while traveling through the simulation. The tasks included inserting a key into a lock to open a door, placing items in and searching for items in buckets located throughout the site, or walking through the simulation site and returning to the door. While the test subjects were walking through the simulation site, the 3:1 and 1:1 compositions were sprayed at a height of 8 feet with a 170° nozzle and at a height of 9 feet with a 150° nozzle. An eye washing unit was immediately available The results of the additional tests with the 3:1 composition and the 1:1 composition are summarized in FIG. 5. As shown in FIG. 5, test subjects were able to perform tasks without involuntary eye closure for up to 20 seconds while being sprayed by the 3:1 composition. Involuntary eye closure occurred between 20 and 30 seconds and lasted until mitigation with water. Other than smell, mitigation of effects by flushing with water occurred in 5 to 20 seconds, depending on the amount of water used for mitigation. Furthermore, both of the two test subjects with asthma reported that mitigation of asthma symptoms began immediately upon introduction of fresh air. This is similar to what was experienced by test subjects in regard to the irritation of the throat and lungs. The pungent odor clings to hair, clothes, nasal passages, and any exposed skin until washed off No special soap was needed to remove the odor. While the 3:1 composition was effective in deterring the test subjects from performing the tasks, the test subjects insisted the solution could be strengthened.

As shown in FIG. 5, the 1:1 composition provided a greater level of effectiveness in a shorter period of time, with impact starting immediately upon contact with solution. Involuntary eye closure occurred within 15 to 25 seconds and lasted until mitigation with water. The mitigation time was slightly increased as compared with the 3:1 composition, and the amount of water needed for mitigation was also slightly increased. As with the 3:1 composition, mitigation of asthma symptoms was reported to begin immediately upon introduction of fresh air, as was mitigation of irritation of the throat and lungs. The pungent odor of the composition also remained until washed off with water. The 1:1 composition was tested multiple times with the same level of effectiveness with no residual effects on the test subjects.

Ongoing monitoring of all the test subjects for residual effects continues, and no test subject has yet reported any lingering effects.

Based on the results shown in FIG. 5, the stronger 1:1 composition was determined to be the more effective deterrent for use as a sprayable deterrent composition. The test subjects agreed that the stronger solution, while more irritating, had no lingering effects and would have quicker results for the deter, disrupt, and delay actions required.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "component" or "element" when used in the singular can have the dual meaning of a single part or a plurality of parts. Accordingly, these terms, as utilized to describe the present invention should be interpreted relative to a pet bowl formed of a bulk molding compound.

The term "configured" as used herein to describe a component, section or part of a device means that the component, section or part is designed to carry out the desired function.

The terms of degree, such as "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A composition comprising:
propionic acid;
ammonia; and
water,
a content of water in the composition being at least approximately 60% by weight, and
a content of propionic acid in the composition being at least approximately 17.5% by weight.

2. The composition according to claim 1, further comprising at least one of citric acid and ethoxylated alcohol.

3. The composition according to claim 1, further comprising a dye.

4. The composition according to claim 3, wherein the dye is a red dye.

5. The composition according to claim 1, wherein the content of propionic acid in the composition is at least approximately 35% by weight.

6. The composition according to claim 1, wherein a pH of the composition ranges from approximately 5.60 to 5.80.

7. The composition according to claim 1, wherein the composition is a liquid.

8. A system for spraying a composition comprising:
a nozzle configured to spray the composition in an area inside a building,
the composition comprising:
propionic acid;
ammonia; and
water,
a content of water in the composition being at least approximately 60% by weight and a content of propionic acid in the composition being at least approximately 17.5% by weight.

9. The system according to claim 8, wherein the composition further comprises at least one of citric acid and ethoxylated alcohol.

10. The system according to claim 8, wherein the composition further comprises a dye.

11. The system according to claim 10, wherein the dye is a red dye.

12. The system according to claim 8, wherein a content of propionic acid in the composition is at least approximately 35% by weight.

13. The system according to claim 8, wherein a pH of the composition ranges from approximately 5.60 to 5.80.

14. The system according to claim 8, wherein the composition is a liquid.

15. The system according to claim 8, wherein the nozzle is sized and configured to be concealed within the building.

16. The system according to claim 8, wherein the nozzle is configured to be in fluid communication with a fire sprinkler system of the building.

17. The system according to claim 8, wherein the nozzle is configured to be in fluid communication with a domestic water supply system of the building.

18. The system according to claim 8, wherein the system is electrically integrated with an electrical supply of the building.

* * * * *